US006467615B1

(12) United States Patent
Müller

(10) Patent No.: US 6,467,615 B1
(45) Date of Patent: Oct. 22, 2002

(54) PACKAGING FOR A SWITCH CABINET

(75) Inventor: Norbert Müller, Dietzhölztal (DE)

(73) Assignee: Rittal Rudolf Loh GmbH & Co. KG, Herborn (DE)

( * ) Notice: Subject to any disclaimer, the term of this patent is extended or adjusted under 35 U.S.C. 154(b) by 0 days.

(21) Appl. No.: 09/807,853

(22) PCT Filed: Aug. 13, 1999

(86) PCT No.: PCT/EP99/05950

§ 371 (c)(1),
(2), (4) Date: Jul. 11, 2001

(87) PCT Pub. No.: WO00/23351

PCT Pub. Date: Apr. 27, 2000

(30) Foreign Application Priority Data

Oct. 19, 1998 (DE) ..... 198 47 924

(51) Int. Cl.[7] ..... B65D 85/00
(52) U.S. Cl. ..... 206/305; 206/320
(58) Field of Search ..... 206/305, 320, 206/386, 597, 599, 600, 223

(56) References Cited

U.S. PATENT DOCUMENTS 2,768,738 A * 10/1956 Whiton et al. ..... 206/320
3,482,895 A * 12/1969 Becklin ..... 206/305
3,650,459 A * 3/1972 Tucker ..... 206/599
4,019,634 A * 4/1977 Bonnot ..... 206/386
4,085,847 A * 4/1978 Jacalone ..... 206/600
4,317,515 A * 3/1982 Feeley et al. ..... 206/499
4,673,087 A * 6/1987 Webb ..... 206/600
4,807,808 A * 2/1989 Reed ..... 229/122
5,004,102 A * 4/1991 Timmins et al. ..... 206/386
5,161,692 A * 11/1992 Knierim ..... 206/320
5,655,382 A * 8/1997 Chen ..... 206/320

FOREIGN PATENT DOCUMENTS

DE 4414813 * 11/1995

* cited by examiner

*Primary Examiner*—Jim Foster
(74) *Attorney, Agent, or Firm*—Pauley Petersen Kinne & Erickson

(57) ABSTRACT

Packaging for dismantled switch cabinet components, whereby the individual components or component sub-assemblies are respectively packed using partial packaging having one or several packaging components. In order to minimize packaging expenditure, the packaging components can also be used as an outer lining for the switch cabinet when assembled.

13 Claims, 1 Drawing Sheet

PACKAGING FOR A SWITCH CABINET

BACKGROUND OF THE INVENTION

1. Field of the Invention

This invention relates to packaging for the components of a disassembled switchgear cabinet or a disassembled switchgear cabinet rack, hereinafter also called switchgear cabinet for short, wherein the individual components or groups of components are each packed in a partial package of one or several package elements.

2. Description of Related Art

In a known form of distribution, the switchgear cabinets are delivered to the customers in a disassembled state. Thus, the prefabricated parts of the switchgear cabinet are respectively packed together individually or in groups. The customer can then unpack the individual components and assemble the switchgear cabinet. However, it is often necessary for the assembled switchgear cabinet to be temporarily stored or conveyed. Because the switchgear cabinet is not protected by packaging material, damage can occur. Relief is then provided because repackaging of the assembled switchgear cabinet is provided by the customer.

Packaging for a refrigerator is known from German Patent Reference DE 44 14 813. The packaging has a cover at the bottom and one at the top. The refrigerator can be placed into the cover on the bottom. The cover at the top rests on the cover of the refrigerator. A lateral covering extends between the covers at the top and at the bottom, which is embodied as a hose made of a fabric. Tightening straps are used for connecting the covers at the bottom and the top.

SUMMARY OF THE INVENTION

It is one object of this invention to provide packaging for a switchgear cabinet, wherein a considerable reduction of the packaging outlay is achieved.

This object is attained with the characteristics described in this specification and in the claims.

Thus, the packaging material for the components of the switchgear cabinet can be converted so that it can also be used for covering the assembled switchgear cabinet. Thus, no additional packaging outlay is required.

In accordance with a preferred embodiment of this invention, one or several lateral coverings can be used as packaging material for one or several lateral switchgear cabinet elements, for example lateral walls, cabinet doors or the like. In accordance with this invention it is therefore possible to separately pack the bottom and cover component groups, as well as the lateral switchgear cabinet elements as components of the switchgear cabinet. These components in particular also define the lateral surfaces of the switchgear cabinet to be covered when the switchgear cabinet is assembled. Thus, in accordance with this invention, the components are packaged so that the associated packaging material can again be used as a cover for these components, even when the switchgear cabinet is assembled.

In order to be able to enclose the ready-assembled switchgear cabinet quickly and simply with little outlay, in one embodiment of this invention the covers at the bottom and top each have a bottom, from which a circumferential edge is angled off, wherein in the assembled state of the switchgear cabinet the bottom rests against the outside at the bottom or the top of the bottom and cover component groups and the edge is arranged at a distance with respect to the bottom/cover component group, so that an insertion area results between the bottom/cover component group and the edge, into which plug-in inserts of the lateral coverings can be inserted. The system of packaging a switchgear cabinet can then proceed so that first the individual parts of the switchgear cabinet are unwrapped from the partial packages. Thereafter, one of the covers is placed on the floor, wherein its edges are upwardly directed. The switchgear cabinet can then be placed on the bottom of this cover. Subsequently the plug-in inserts of the lateral coverings can be inserted into the insertion area between the edge and the bottom component group. Then the second cover, which covers the cover component group, can be placed on the inserted lateral coverings. During this the facing plug-in inserts of the lateral coverings also enter into the insertion areas. The packaging assembled in this way can then be secured by adhesive strips or strapping tape.

In their function as covering elements for the assembled switchgear cabinet, the lateral coverings can be embodied so that they have two legs, spaced apart parallel from each other, which are connected with each other in a U-shape by means of a connecting section. The connecting section completely covers a side of the switchgear cabinet, and the legs cover the adjoining sides of the switchgear cabinet, at least partially. Two U-shaped lateral coverings, whose legs are directed toward each other, can be used, in particular for covering the assembled switchgear cabinet.

However, it is also possible for the lateral coverings to have two legs extending vertically with respect to each other, each of which covers a side of the switchgear cabinet, at least partially.

In accordance with a preferred embodiment of this invention, the packaging elements are of corrugated paperboard, which is covered on one or both sides with cardboard. This material has a sufficient stability, which makes it possible to cover even large lateral surfaces of the assembled switchgear cabinet without the need for additional reinforcing measures. Moreover, the corrugated paperboard can be easily recycled.

BRIEF DESCRIPTION OF THE DRAWINGS

This invention will be explained in greater detail in view of an exemplary embodiment represented in the drawings, wherein.

DESCRIPTION OF PREFERRED EMBODIMENTS

Figure 1:
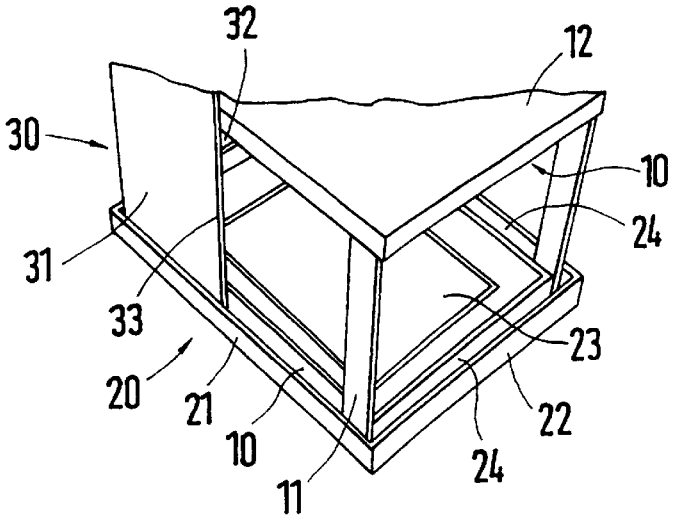
FIG. 1 is a switchgear cabinet rack in a perspective view from above, which is partially enclosed in packaging material.

A switchgear cabinet rack, which has a bottom and cover component group 10, is represented in a perspective partial view in FIG. 1. The bottom component group 10 is connected with the cover component group 10 via vertical profiled frame sections 11. The cover component group 10 is closed off by means of a covering sheet metal piece 12 on the top. The switchgear cabinet rack can be enclosed in packaging material. The packaging material has four main components. These are in detail two covers 20 and two lateral coverings 30. Each of the covers 20 and the lateral coverings 30 is constructed in the same way.

Figure 2:
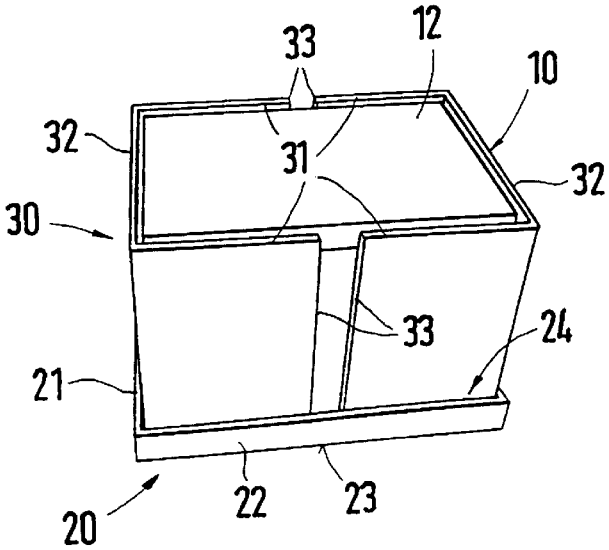
FIG. 2 is a perspective frontal view of the switchgear cabinet rack shown in FIG. 1, but wherein packaging is further completed.

The cover 20 has a flat bottom 23, from which an edge 21, 22 is angled off at right angles. The edge 21, 22 is formed over the circumference. As FIG. 2 shows, the lateral coverings 30 have two legs 31, which are parallel with each other and are connected with each other by means of a connecting section 32.

For packaging the switchgear cabinet rack, the bottom component group 10 is placed on the bottom 23 of the cover 20. In this case the edges 21, 22 of the cover 20 are at a distance from the bottom component group 10, so that a circumferential insertion area 24 results. The lateral coverings 30 can be inserted into the insert area 24 by means of plug-in shoulders. As FIG. 2 shows, the two connecting sections 32 of the lateral coverings 20 cover two sides of the switchgear cabinet rack. The legs 31 adjoining them at right angles partially cover the remaining sides of the switchgear cabinet rack. Here, end sections 33 of the legs 31 of the two lateral coverings 30 are at a distance from each other. It is also conceivable that the end sections 33 overlap each other.

Figure 3:
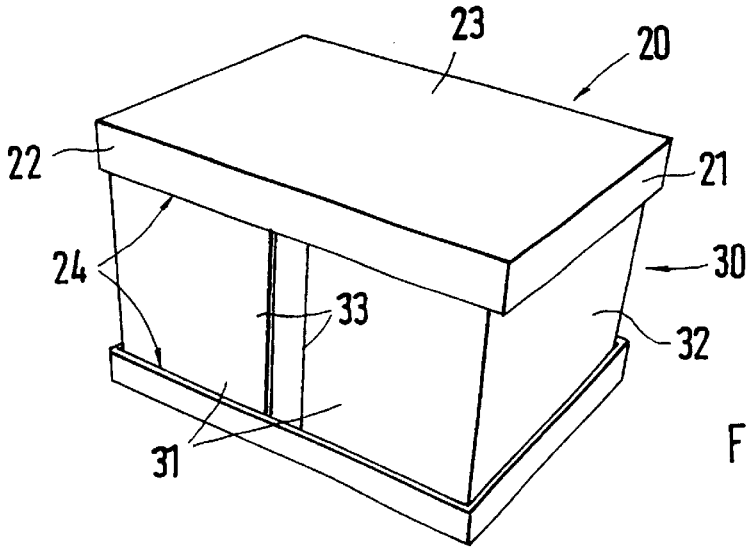
FIG. 3 is a perspective lateral view of the completely packaged switchgear cabinet rack in accordance with FIGS. 1 and 2.

As FIG. 3 shows, the completion of packaging takes place by means of a further cover 20. The cover 20 is plugged over the lateral coverings 30. In the process, the plug-in shoulders on the top of the lateral coverings 30 enter into the plug-in areas 24 formed between the edges 21, 22 and the cover component group 10. In the assembled state of the upper cover 20, the bottom 23 rests on the covering sheet metal piece 12 of the switchgear cabinet rack. To fix the individual packaging elements in place, adhesive tapes or strapping tape can be used. The packaging represented in FIGS. 1 to 3 is also used for covering the individual parts of the switchgear cabinet. The bottom and cover component groups 10 can be packed together as one packaging unit. The two covers 20 are used for this purpose. The two shell-shaped covers 20 are placed around the bottom, and cover component groups 10 in such a way that they are enclosed on all sides. The lateral coverings 30 are used for packing the front and the rear switchgear cabinet door. Each one of the switchgear cabinet doors is packed in its own lateral covering 30.

What is claimed is:

1. In a packaging for containing components of a switchgear cabinet, the improvement comprising:

the components having a bottom component group (10) and a top component group (10) and at least one lateral switchgear cabinet element, the packaging having covers, including a first cover (20) at a bottom and a second cover (20) at a top, and at least one lateral covering (30), said lateral covering (30) defining at least one packaging element, the bottom component group (10) and the top component group (10) packaged with the first cover (20) and the second cover (20), the at least one lateral switchgear cabinet element packed in the at least one lateral covering (30), the at least one packaging element covering the assembled switchgear cabinet, the first cover (20) covering the bottom component group (10) and the second cover (20) covering the top component group (10) at least partially on the bottom and on the top, the at least one lateral covering (30) extending between the first cover (20) and the second cover (20), and the bottom component group (10) and the top component group (10) includes the first cover (20) on the bottom and the second cover (20) on the top.

2. In the packaging in accordance with claim 1, wherein the at least one lateral covering (30) is a packaging material for the at least one lateral switchgear cabinet element.

3. In the packaging in accordance with claim 2, wherein the first cover (20) at the bottom and the second cover (20) at the top has a bottom (23) from which a circumferential edge (21, 22) is angled off, and in an assembled state of the switchgear cabinet the bottom (23) rests against an outside at the bottom or the top of the bottom component group (10) and the top component group (10) and the edge (21, 22) is at a distance with respect to the bottom component group (10) and the top component group (10), so that an insertion area (24) is between the bottom component group (10) and the top component group (10) and the edge (21, 22) into which plug-in inserts of the at least one lateral covering (30) can be inserted.

4. In the packaging in accordance with claim 3, wherein as covering elements for the assembled switchgear cabinet, the at least one lateral covering (30) each has two legs (31) spaced apart parallel from each other and connected with each other in a U-shape with a connecting section (32), the connecting section (32) completely covers a side of the switchgear cabinet, and the legs (31) at least partially cover adjoining sides of the switchgear cabinet.

5. In the packaging in accordance with claim 4, wherein for covering the assembled switchgear cabinet two U-shaped lateral coverings (30) are employed with the legs (31) directed toward each other.

6. In the packaging in accordance with claim 4, wherein as a covering element for the assembled switchgear cabinet, the at least one lateral covering (30) each has two legs extending vertically with respect to each other and each at least partially covers a side of the switchgear cabinet.

7. In the packaging in accordance with claim 6, wherein the packaging elements have corrugated paperboard covered on at least one side with cardboard.

8. Packaging in accordance with one of claims 1 to 7, characterized in that the packaging elements consist of corrugated paperboard, which is covered on one or both sides with cardboard.

9. In the packaging in accordance with claim 1, wherein the first cover (20) at the bottom and the second cover (20) at the top has a bottom (23) from which a circumferential edge (21, 22) is angled off, and in an assembled state of the switchgear cabinet the bottom (23) rests against an outside at the bottom or the top of the bottom component group (10) and the top component group (10) and the edge (21, 22) is at a distance with respect to the bottom component group (10) and the top component group (10), so that an insertion area (24) is between the bottom component group (10) and the top component group (10) and the edge (21, 22) into which plug-in inserts of the at least one lateral covering (30) can be inserted.

10. In the packaging in accordance with claim 1, wherein as covering elements for the assembled switchgear cabinet, the at least one lateral covering (30) each has two legs (31) spaced apart parallel from each other and connected with each other in a U-shape with a connecting section (32), the connecting section (32) completely covers a side of the switchgear cabinet, and the legs (31) at least partially cover adjoining sides of the switchgear cabinet.

11. In the packaging in accordance with claim 9, wherein for covering the assembled switchgear cabinet two U-shaped lateral coverings (30) are employed with the legs (31) directed toward each other.

12. In the packaging in accordance with claim 1, wherein as a covering element for the assembled switchgear cabinet, the at least one lateral covering (30) each has two legs extending vertically with respect to each other and each at least partially covers a side of the switchgear cabinet.

13. In the packaging in accordance with claim 1, wherein the packaging elements have corrugated paperboard covered on at least one side with cardboard.

* * * * *